United States Patent [19]

Layton

[11] Patent Number: 4,859,113

[45] Date of Patent: Aug. 22, 1989

[54] PAVER WITH DISCONTINUOUS DISCS MOVING AGGREGATE CONTAINED IN THE PAVER

[76] Inventor: Jack D. Layton, 4468 Medina La., SE., Salem, Oreg. 97301

[21] Appl. No.: 220,156

[22] Filed: Jul. 18, 1988

[51] Int. Cl.[4] ..... E01C 19/48

[52] U.S. Cl. ..... 404/101; 404/108

[58] Field of Search ..... 404/101, 105, 106, 108, 404/110; 222/236, 237, 241; 414/501, 502, 526; 239/672; 198/308.1

[56] References Cited

U.S. PATENT DOCUMENTS

| | | | |
|---|---|---|---|
| 2,964,391 | 12/1960 | Benson | 366/316 X |
| 3,044,750 | 7/1962 | Schmitt, Jr. | 366/316 X |
| 3,417,851 | 12/1968 | Gonski et al. | 198/308.1 |
| 4,487,339 | 12/1984 | Ellwood | 222/236 |
| 4,676,405 | 6/1987 | Lents et al. | 222/236 X |
| 4,718,790 | 1/1988 | Layton | 404/101 |

*Primary Examiner*—Jerome W. Massie
*Assistant Examiner*—Matthew Smith
*Attorney, Agent, or Firm*—Kolisch, Hartwell & Dickinson

[57] ABSTRACT

A paver with a collecting hopper for collecting aggregate dumped into the paver. Rotating discs with discontinuous expanses caused by voids in the discs on rotation of the discs mix aggregate and move the aggregate to a region where the aggregate dumps in advance of a screed in the paver.

8 Claims, 2 Drawing Sheets

PAVER WITH DISCONTINUOUS DISCS MOVING AGGREGATE CONTAINED IN THE PAVER

BACKGROUND AND SUMMARY OF THE INVENTION

This invention relates to so-called pavers or finishers, of the type adapted to receive aggregate, such as a mixture of crushed rock and asphalt, and then to spread the aggregate as a smooth layer over a surface being paved. In the usual instance, the aggregate is supplied to the paver from a dump truck which is positioned in front of the paver and which, with raising of the dump body in the truck, dumps aggregate into a receiving hopper which is provided in the paver.

With larger units having a receiving hopper of appreciable size, problems have been experienced in moving aggregate deposited within the hopper whereby such may be caused to cascade downwardly from the hopper into the region being paved and in advance of any screed in the paver, which is the instrumentality in the paver that smooths and spreads the material on the surface being paved. If the hopper is made tiltable to cause material to flow by gravity downwardly in advance of the screed, problems arise in connection with the dump truck which supplies the paver material. Specifically, on raising of the hopper, the hopper tends to move against the dump body of the truck which limits its upward movement and which requires that the truck move away from the paver during such tilting movement. If the dump truck has not fully dumped its load, it must then back up against the paver to complete depositing its load, this being preceded by lowering of the hopper to permit such movement. The operation described is time consuming. To obviate the problem, drag chains and the like may be included which extend along the base of the hopper for moving material rearwardly and toward the screed region. However, a drag chain has a return run which of necessity travels under the hopper. A drag chain is difficult to clean, and the return run described tends to drag material with it under the base of the hopper.

In U.S. Pat. No. 4,718,790, there is disclosed a paver with one or more rotating discs which form the floor of the hopper in the paver. With rotation of the discs, aggregate within the hopper is caused to be moved rearwardly to a region where the material cascades downwardly in advance of the screed of the paver. The construction disclosed in the patent obviates the problems above generally discussed, in enabling control of material flow without requiring that the hopper be tilted completely to achieve it, and without the problems encountered by drag chains or similar conveyor systems.

Disclosed herein is a form of paver constituting an improvement in the class of paver generally disclosed in the above-identified prior issued patent. More specifically, the invention resides in an improved form of disc or discs to be incorporated with such a paver, which promotes aggregate mixing and distribution during the paving process. A further and related feature of the invention is the provision of a paver incorporating one or more discs for producing aggregate movement which may have a lighter weight than when discs of comparable overall size are used as disclosed in the prior patent.

In a specific and preferred embodiment of the invention, a disc is provided which has arms extending outwardly from a central hub which mounts the arms with the outer extremities or ends of the arms forming the perimeter of the disc. The arms have voids or spaces therebetween separating one arm from another, which material may fall into during operation of the disc to produce mixing and churning and a more aggressive feed of the material which overlies the disc. Material working to the arm extremities is discharged in advance of the screed in the paver which does the leveling operation. A detachable mounting may be provided for connecting the arms to the hub, to enable replacement of one or more arms for repair or maintenance purposes.

BRIEF DESCRIPTION OF THE DRAWINGS

These and other objects and advantages are obtained by the invention, which is described hereinbelow in conjunction with the accompanying drawings, wherein.

DETAILED DESCRIPTION OF THE PREFERRED EMBODIMENT

Figure 1:
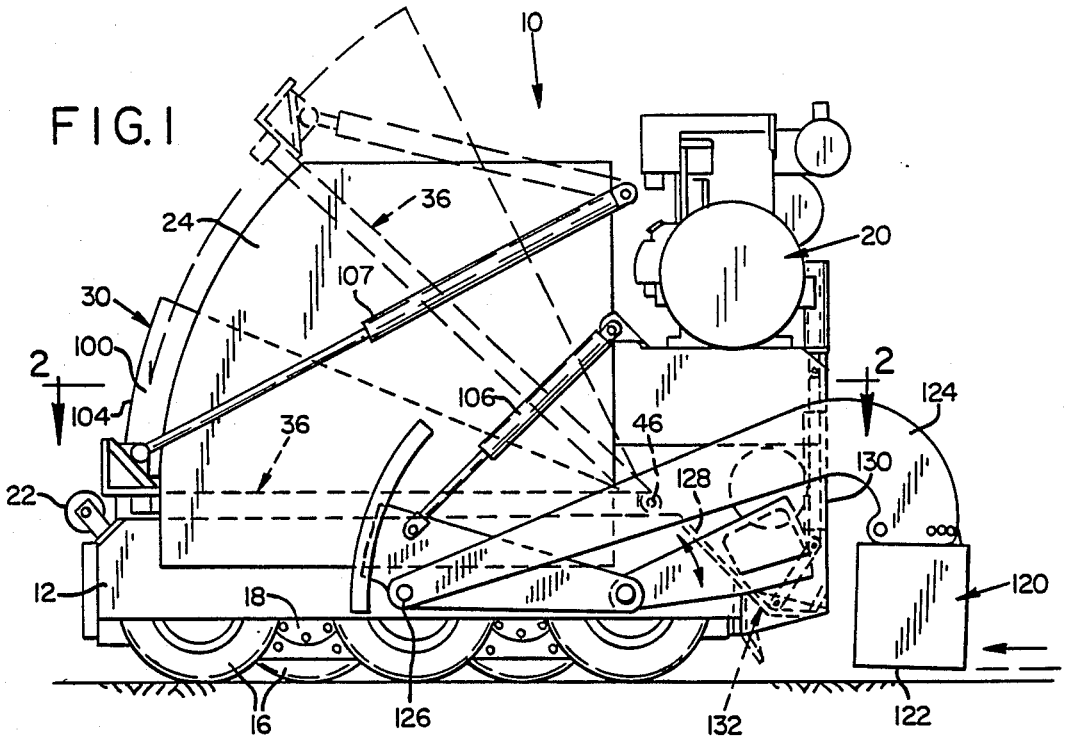
FIG. 1 is a side elevation, illustrating a paver as contemplated herein.

Referring now to the drawings, and more particularly to FIG. 1, the paver illustrated in external appearance may have a construction similar to that disclosed in the prior-referenced patent. The paver is shown at 10, and in use the paver travels behind or trails a dump truck traveling in front of the paver, which would be to the left of the paver as shown in FIG. 1. During operation, the paver functions to collect aggregate dumped thereinto from the dump truck and to spread such in a layer. In this description, the longitudinal axis of the paver is construed as extending in the direction that the paver travels.

The paver includes a frame 12. Mounted on the frame and supporting the paver for movement over the ground are wheels, or ground-traveling means, illustrated at 16. In a preferred embodiment and in the embodiment illustrated, the paver is a self-propelled unit, in that such is powered under its own power during the paving operation (as compared to a tow-type paver which is coupled to the dump truck and which is towed by the truck while paving proceeds). Toward these ends, the wheels 16 are power-driven by means including the drive transmission partially shown at 18. Powering the drive transmission are conventional hydraulic motors (not shown), provided with fluid under pressure from a supply including an internal combustion engine and a pump assembly, shown generally at 20, mounted on frame 12 in an elevated position adjacent the rear of the paver.

During paver operation and while receiving aggregate, the paver travels in trailing relation behind a dump truck, with rollers, such as the rollers shown at 22, rotatably mounted on the paver frame engaging the rear wheels of the dump truck. These rollers establish the proper trailing relationship of the paver to the dump truck.

Figure 2:
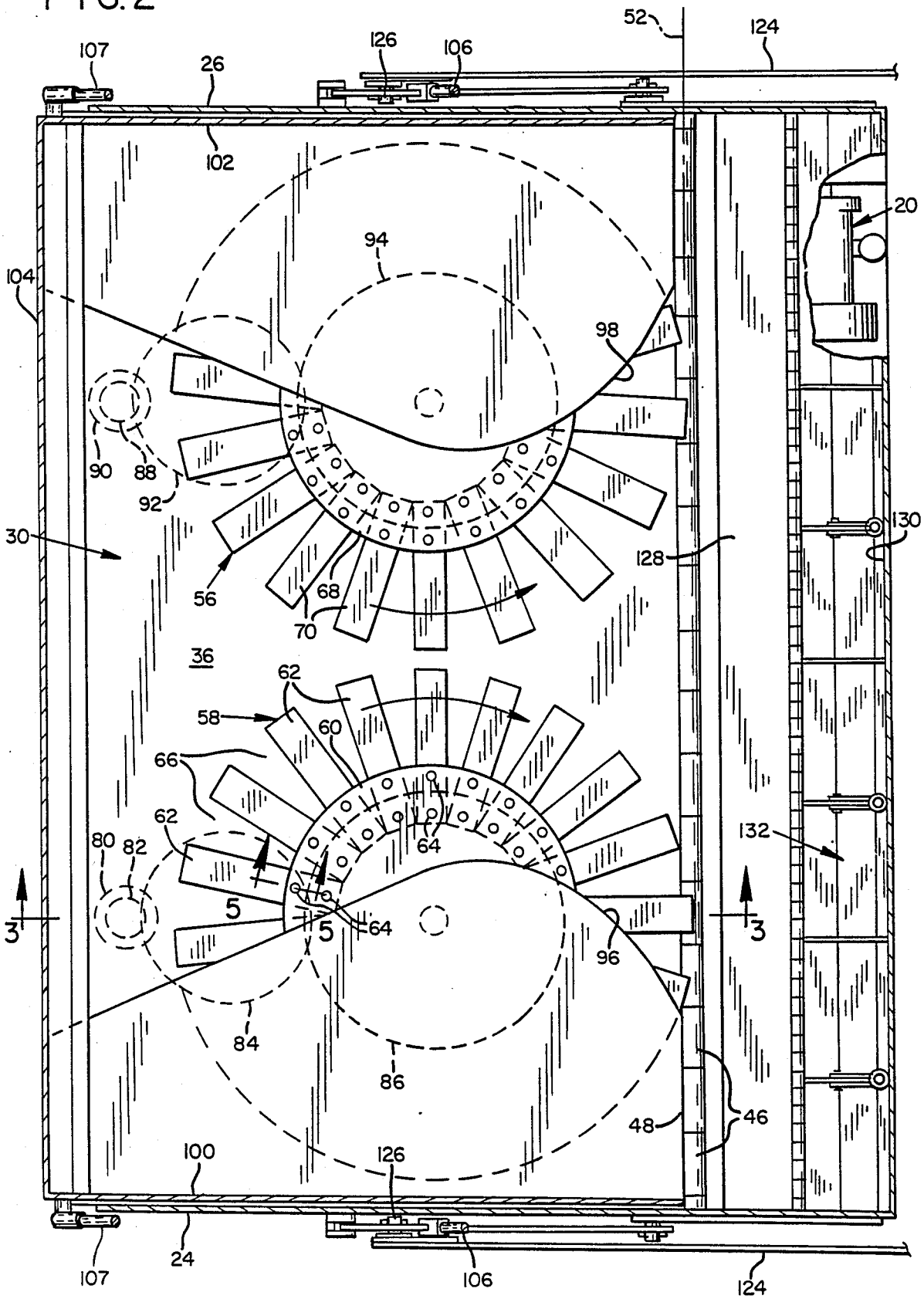
FIG. 2 is a view, on a somewhat enlarged scale, looking downwardly at the floor of a collecting hopper in the paver as such would appear in a view taken generally along the line 2—2 in FIG. 1.

The paver includes, and referring to FIGS. 1 and 2, side walls 24, 26 which are secured to the frame of the paver in an upright position. What is referred to herein as a collecting hopper is mounted on the paver in the space bounded by these side walls, and in the drawings the collecting hopper has been given the general reference numeral 30.

Collecting hopper includes a panel assembly 36 which forms a base or subfloor in the paver and which in plan view has a substantially rectangular configuration. As probably best illustrated in FIG. 3, the top of the panel assembly is formed by a sheet 38 and forming the bottom of the panel assembly is a sheet 40. These are suitably secured to an interbracing framework 42 with the assembly thus being made into a rigid unit.

Figure 3:
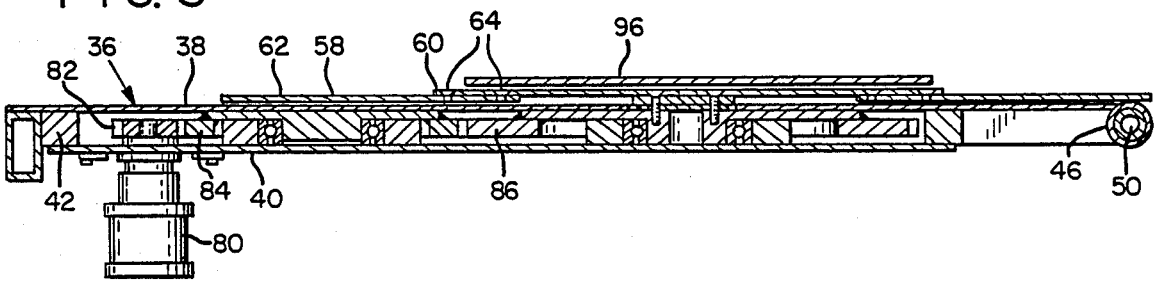
FIG. 3 is a cross-sectional view, taken generally along the line 3—3 in FIG. 2.

Suitably secured in the panel assembly, along the right edge thereof, as such is viewed in FIGS. 2 and 3, are sleeve segments 46. The sleeve segments are located at spaced intervals along this edge of the panel assembly and have interspersed therewith sleeve segments 48 which are secured to the paver frame. The sleeve segments 46, 48 receive an elongate pin 50 whereby a piano-type hinge is provided hingedly pivotally connecting the panel assembly to the paver frame. The pivot axis provided by this hinge assembly extends horizontally and transversely of the paver, adjacent the rear edge of the panel assembly, and has been given the reference numeral 52 in FIG. 2.

Considering further the construction of the collecting hopper, and as illustrated in FIGS. 2 and 3, overlying sheet 38, and rotatably mounted in a position disposed above the panel assembly, are a pair of disc assemblies 56, 58. These have, as shown, substantially the same overall outer diameter, and are disposed side by side in a direction extending transversely of the paver. Rear peripheral margins of these respective disc assemblies overlay and are adjacent the rear edge of panel assembly 36.

Considering the construction of the disc assemblies, and considering disc assembly 58, in the embodiment of the invention shown in FIG. 2, the disc assembly includes a central hub 60 which may, as illustrated, have a substantially circular outline. Mounted on this hub and extending outwardly from its perimeter are multiple arms 62. These arms, as in the embodiment illustrated, may take the form of elongate plate segments of substantially equal width and with inner ends secured to the hub. The arms may be secured to the hub as by welding, but preferably by a detachable system, as exemplified by screw fasteners 64 securing the inner end of each arm to the hub. By using the detachable means for mounting the arms, one or more arms may be removed and replaced, as when repairing a damaged arm, or should it be desired to change the configuration of the arms for a different type of distribution action. The arms have outer ends which form the perimeter of the disc assembly, the arms being of uniform width and radiating out from the hub, voids or spaces 66 are defined between respective arms with the subfloor of the hopper exposed through these voids. Speaking in more general terms, the hub and arms collectively provide a disc which is noncontinuous over its extent by reason of the voids described.

Disc assembly 58 may have a construction similar to that of assembly 56, including a hub 60 and arms 62 mounted thereon and radiating outwardly form the hub.

Means is provided for rotating each of the discs under power with the discs rotating in opposite directions. Specifically, and referring to disc 58 as illustrated in FIG. 3, suitably secured to the underside of panel assembly 30 is a hydraulic motor 80 supplied with pressurized hydraulic pressure fluid from the engine and pump assembly 20. The output shaft of motor 80 is secured to a pinion gear 82 suitably mounted within the interior of panel assembly 36. The teeth of pinion gear 82 mesh with the teeth of an idler gear 84 suitably journaled within the panel assembly. In turn, the teeth of gear 84 mesh with the teeth of a bull gear 86 suitably journaled within the panel assembly. The bull gear is suitably nonrotatably secured to hub 60. A similar drive system comprising hydraulic motor 88 and gears 90, 92, 94 drives disc or hub 68 of disc 58.

The discs are partially overlaid by shield plates suitably rigidly supported in the collecting hopper and extending from one side of the hopper. These shield plates are shown at 96, 98. The shield plates cover side margins of the discs where such margins are moving away from the rear edge of panel assembly 56.

Completing the description of the collecting hopper, forming the sides of the hopper are hopper sides 100, 102 each having approximately triangular configuration as such is viewed in FIG. 1. These are suitably rigidly secured to panel assembly 36 in positions paralleling and closely adjacent respective side walls 24, 26.

The end of the collecting hopper which faces forwardly in the paver is closed off by hopper end wall 104.

The collecting hopper has a lowered position as shown in FIG. 1, where panel assembly 36 extends horizontally. The hopper is tiltable by pivoting such about axis 52 to the raised position indicated in dashed outline in FIG. 1. In this position, the panel assembly and the discs which overlie it occupy sharply inclined positions.

A power-operated means is provided for tilting the collecting hopper and adjustedly positioning it between these two extreme positions. Such comprises an extensible-contractible ram 107 having a cylinder end pivotably connected to a side wall of the paver and its rod end connected to the collecting hopper adjacent the end thereof which faces forwardly in the paver. If desired, another ram may be provided for raising the hopper associated with the side wall of the paver which is obscured from the viewer in FIG. 1, i.e., the side wall on the opposite side of the paver from the side shown in FIG. 1.

From the above description, it should be apparent that a substantial portion of the floor of the hopper is formed by the exposed portions of disc assemblies 56, 58. During operation of the paver and to produce movement of the material toward the rear edge of the collecting hopper, the discs are rotated in the directions of the arrows shown in FIG. 2, such movement tending to carry aggregate rearwardly in the hopper toward the rear edge of the hopper.

With the arms provided in the discs, there is a churning and mixing function which is performed which is important. Furthermore, there is an aggressive feeding of the aggregate material toward the edge of the hopper which occurs at the perimeter of each disc. Further explaining, aggregate material within the hopper tends to be supported not only on the hub of each disc and the upper surfaces of the arms provided with each disc, but also on the exposed subfloor which is exposed through the voids provided between the arms. Thus, as a disc is rotated, the arms of the disc move through such material to cause such to roll and turn, and also to cause such material to move peripherally on the disc. In this way, residual material within the hopper and newly dumped material tend to be intermixed to produce an even mixture being moved rearwardly to the rear edge of the hopper. This churning and mixing action is particularly advantageous in circumstances, for instance, such as when a new load of aggregate is dumped into the hopper, which may inadvertently have a temperature below that which would optimally be used in the spreading of the aggregate. With such conditions and with a smooth faced disc, such tends to move under the cooler material with the discs sliding freely under the material and without sufficient churning of the material. The discontinuous discs of the invention prevent this, assuring that there is churning and mixing of material even though such be below the optimal temperature desired.

Another feature of the invention is such churning and mixing action is promoted without introducing mass or weight to the construction of the paver. In fact, with the construction selected, the mass of the disc assemblies may be reduced from that where nonperforate, solid discs are employed. Much of the material, in effect, is supported on the subfloor of the hopper where such is exposed through the discs. Any such material through the churning action of the rotating arms is either moved upwardly to move over the upper parts of the arms when the arms move through the material, or is caused to be advanced circumferentially and radially outwardly on a disc, to be advanced toward the rear edge of the hopper, where such may then fall to be spread on the surface being paved.

Figure 4:
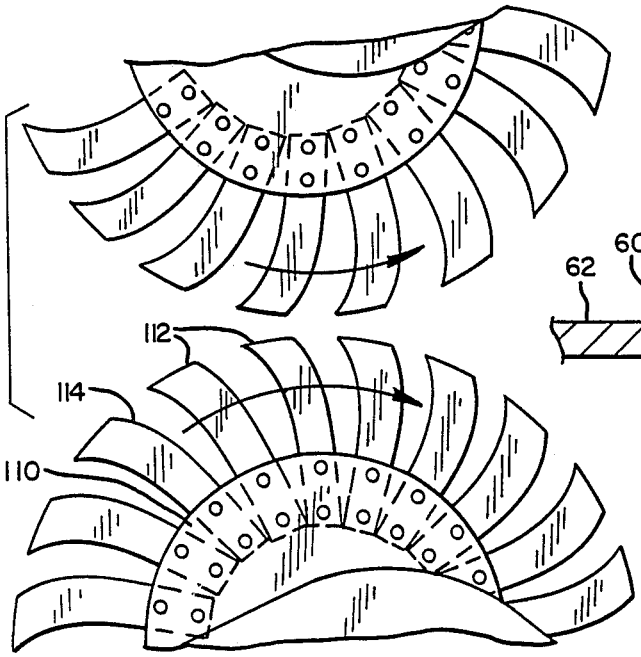
FIG. 4 is a view showing portions of a floor in a paver pursuant to modification of the invention and looking downwardly at the floor as in FIG. 2.
Figure 5:
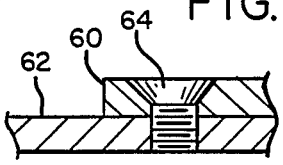
FIG. 5 is a somewhat enlarged view, taken generally along the line 5—5 in FIG. 2.

The arms may take various forms and shapes in a hopper as contemplated. In FIG. 4, a modified form of discs is illustrated. Each disc includes a hub 110 mounting arms 112 with leading edges 114 on these arms which incline rearwardly progressing outwardly on the disc from radial lines projected from the center of the disc. In FIG. 4, the leading edges of the arms actually extend in a curve, so that this incline is not uniform but increases progressing outwardly on an arm. Whether the leading edges extends in a straight line and at an incline or as a curved line and at an incline, the effect is to tend to cause material to be thrown outwardly further with a given amount of rotation of a disc, and a tendency to increase the self-cleaning action of the disc as such is rotated through the aggregate material.

Further considering the construction of the paver, and referring to FIG. 1, pulled by the paver in trailing relation to the hopper just described is what is referred to as a screed assembly shown at 120. This assembly comprises an elongate structure extending transversely of the paver bottomed by a surface 122 which functions to level and smooth aggregate placed in advance of the assembly as the paver moves forwardly along the area being paved. The screed assembly is supported on opposite sides of the paver by an elongate arm, such as the one shown at 124 in FIG. 1. Ends of these arms at the forward end of the paver may be pivotably supported by pivot means 126, whereby the screed assembly may be raised and lowered with a pivoting action using ram 106. Reference may be made to the earlier referenced U.S. patent for further details as to the construction and operation of the screed assembly and its mounting in the paver.

Referring to FIGS. 1 and 2, extending under sleeve segments 46, 48 pivotably mounting the collecting hopper, and thence rearwardly and downwardly in the paver, is a wall 128. This wall, plus the bottom portion of wall 130 which is opposite wall 128, collectively define what is referred to herein as a feed hopper in the paver. This feed hopper has an opening at the top thereof located rearwardly and below the rear edge of panel assembly 36 (formed by sleeve segments 46, 48) adapted to collect material fed thereinto which cascades from the collecting hopper by gravity and under the action of rotating discs 56, 58. Flow from the feed hopper may be controlled by operation of a gate 132 which is power actuated to open and close the degree of opening at the base of the feed hopper.

The operation of the paver should be obvious from the above description. With aggregate dumped into the collecting hopper from a dump truck or other instrumentality, such may be caused to flow into the feed hopper and thence under the screed through tilting of the collecting hopper and/or through operation of the disc assemblies described. When the disc assemblies are rotated, such serve not only to move material rearwardly in the collecting hopper, but also promote a churning movement in the aggregate whereby the aggregate supported over the discs tends to be broken up and mixed. Material between the voids existing between the arms of the discs and which is supported on the subfloor of the collecting hopper is moved against the reaction force supplied by the supporting floor to be churned upwardly and to mix with other material, or is shifted outwardly to be additionally mixed or to fall over the rear margin of the hopper in advance of the screed. A relatively aggressive feeding action is promoted, whereby material tends to be fed over the rear edge of the hopper along its entire length, minimizing distribution problems of material once such has fallen into the feed hopper.

The construction contemplated, furthermore, in a manner of speaking, is self-cleaning, in that material that falls into the voids existing between the successive blades of a disc tends continuously to be moved out of these voids with rotation of a disc.

While embodiments of the invention have been described, obviously variations and modifications are possible without departing from the invention.

It is claimed and desired to secure by Letters Patent:

1. In a paver having a collecting hopper for collecting aggregate dumped thereinto from a supply, a screed extending transversely of the paver and spaced longitudinally from the collecting hopper, and an elongate opening defined in the paver which is substantially parallel to and spaced from the screen for feeding aggregate from the hopper to a region in advance of the screed, a subfloor in the hopper and a rotary disc overlying the subfloor, the disc forming a portion of the floor in said collecting hopper and the disc being rotatable about a substantially upright axis, said disc having voids extending through the disc and said voids exposing the subfloor in the hopper, said disc being operable on rotation to move aggregate located in the hopper above the disc toward said opening, and said voids catching aggregate to promote motion of the aggregate lying over the disc.

2. The paver of claim 1, wherein said disc includes a central hub portion, and plural arms with spaces therebetween secured to and extending outwardly from the hub portion, ends of the arms forming the perimeter of the disc, said voids being defined by the spaces between the arms.

3. The paver of claim 2, wherein said arms are elongate plate segments, and detachable means mount said plate segments on said hub portion.

4. The paver of claim 2, wherein said arms are equally circumferentially spaced about said hub portion.

5. The paver of claim 4, wherein said arms having lead edges that lead the arms with rotation of the disc, said lead edges inclining rearwardly from radial lines extending outwardly from the center of the disc.

6. In a paver having a frame, ground-traveling means supporting the frame for movement over the ground, a collecting hopper mounted on the frame for collecting aggregate dumped thereinto, said hopper having a base and the base terminating at a rear edge extending transversely of the paver, means pivotally mounting the hopper for adjustable pivotal movement about a horizontal axis extending transversely of the paver and adjacent the rear edge of the hopper, and a pair of side-by-side rotating discs disposed over the hopper base and forming a portion of the floor of the hopper rotatable about upright parallel axes and having respective margins located adjacent the rear edge of the hopper, each of the discs having voids extending through the disc and these voids exposing the base in the hopper, said discs being operable with rotation of the discs to move aggregate located in the hopper toward said rear edge of the hopper, said voids during such rotation catching aggregate to produce motion of the aggregate while the discs operate to move aggregate toward said rear edge.

7. The paver of claim 6, wherein each disc includes a central hub portion and plural arms joined to and extending outwardly from the hub portion, ends of said arms forming the perimeter of the disc and said voids being defined by spaces provided between the arms.

8. The paver of claim 7, wherein said arms have lead edges which lead the disc with rotation of the disc, and said lead edges incline rearwardly on the disc from radial lines extending from the center of the disc.

* * * * *